United States Patent [19]

Saxby

[11] 4,361,093

[45] Nov. 30, 1982

[54] AMMUNITION FOR SMALL ARMS

[75] Inventor: Michael E. Saxby, Norton Lindsey, England

[73] Assignee: Hilvenna Limited, England

[21] Appl. No.: 92,825

[22] Filed: Nov. 9, 1979

[30] Foreign Application Priority Data

| | | | |
|---|---|---|---|
| Nov. 30, 1978 | [GB] | United Kingdom | 46601/78 |
| Jul. 9, 1979 | [GB] | United Kingdom | 7923875 |
| Jul. 24, 1979 | [GB] | United Kingdom | 7925833 |

[51] Int. Cl.[3] ..... F42B 5/16

[52] U.S. Cl. ..... 102/447; 102/430; 102/529; 102/446; 42/77

[58] Field of Search ..... 102/444, 441, 446, 447, 102/529, 465, 439, 430; 42/77

[56] References Cited

U.S. PATENT DOCUMENTS

| | | | |
|---|---|---|---|
| 220,030 | 9/1879 | McGowan | 102/444 |
| 1,817,273 | 8/1931 | Schuler | 102/444 |
| 3,060,856 | 10/1962 | Dunn | 102/447 |
| 3,611,937 | 12/1971 | Hildebrand | 102/446 |
| 3,640,013 | 2/1972 | Franklin | 102/446 |

FOREIGN PATENT DOCUMENTS

| | | | |
|---|---|---|---|
| 7228 | of 1908 | United Kingdom | 42/77 |

*Primary Examiner*—Harold J. Tudor
*Attorney, Agent, or Firm*—Neil F. Markva

[57] ABSTRACT

A round of ammunition in which a primer cap provides the sole means for propelling a lightweight missle from a cartridge casing shaped to fit into an existing firearms firing chamber. A removable insert in the cartridge casing 12 provides an elongate passage which moderates the force of the primer cap explosion to avoid damaging the missile. The casing is reloadable from the base to allow a fresh missile to be inserted, and in an alternative embodiment a two part insert is provided which likewise allows a missile to be inserted from the base end. In all embodiments the missile is preferable in the form of an air gun pellet, and the ammunition is preferably used with a liner assembly adapted to minimize damage to the missile.

11 Claims, 8 Drawing Figures

AMMUNITION FOR SMALL ARMS

BACKGROUND OF THE INVENTION

This invention concerns improvements in or relating to ammunition for small arms such as pistols, revolvers, rifles and like firearms.

It is known to use practice ammunition in which the explosive charge is reduced as compared with standard ammunition for various purposes, e.g. practicing shooting indoors, target shooting at fairgrounds and training, in order to obtain a reduction in the dangers involved, but even when the charge is reduced to the minimum necessary to achieve reasonable accuracy during firing, the bullet, due to its weight, still has a dangerous amount of kinetic energy. In order to reduce the kinetic energy, it has been proposed to use plastics bullets instead of the usual metal bullets, but it has been found that the accuracy is reduced when plastic bullets are used. Also, it is known to sleeve down a large caliber handgun to a smaller caliber by means of a barrel liner, to enable missiles of lower kinetic energy to be used, but such conversions require the firing chamber and magazine of the gun to be modified.

The costs involved in using such forms of ammunition are high because all these rounds of ammunition comprise a cartridge casing, a primer, the explosive charge, and the missile, all of which are expended during firing.

Various inventions have recently been made by the Inventor in order to try and further reduce said dangers and to avoid reductions in said costs.

In one of said inventions the Inventor proposed to use a barrel liner and a standard air gun pellet of 0.177 or 0.22 caliber in order to employ a lightweight low cost mass produced missile, in combination with a form of cartridge which contained a compressed air chamber and valve means to enable the compressed air to be released for propelling the missile from a mouth at the front or nose end of the cartridge. The compressed air chamber and valve means were designed to be rechargable with compressed air. However, such air gun pellets have a relatively fragile and easily damaged thin skirt at the trailing end of the missile. It was found by the inventor, during testing, that the skirt could be damaged as it was loaded skirt first into the mouth, so that the pellet faced forward ready to be fired out of the mouth. Also, recharging of the cartridge with compressed air had to be performed under clinically clean conditions. Otherwise, the valve means could become faulty due to the presence of dirt and foreign matter.

However, the rechargable compressed air ammunition had great advantages when compared with the known explosive practise ammunition. There was a great reduction in the kinetic energy necessary to achieve accurate shooting, there was no pollution, and only the pellets were expended as the cartridge was rechargable, but the cartridge was relatively expensive to produce.

What is still needed is a form of practice ammunition which is relatively inexpensive to produce, and inexpensive to use, which affords as many as possible of the advantages of the known practice ammunition and the compressed air rechargable round of ammunition proposed by the Inventor, and which enables the aforementioned disadvantages to be reduced or to be avoided.

SUMMARY OF THE INVENTION

In the present invention it is proposed to employ a cartridge casing which, like the casing employed in some known rounds of practice ammunition, comprises an internal chamber which has a first portion which extends from a base opening to a junction with a second portion. The second portion has a smaller diameter than the first portion and extends from said junction to a nose opening. A primer cap of generally known form is located so that it occupies at least part of the base opening of the cartridge casing. However, the present invention is characterized by the missile being located in the internal chamber. An insert is disposed in the first portion so that it provides an empty internal passage which extends from adjacent the primer cap to adjacent the missile. The empty passage is sufficiently narrow to prevent the missile entering the empty passage. The insert and primer cap are extractable via the base opening to enable the round to be reloaded with a further missile by inserting the further missile nose forwards into the casing through the base opening.

In particular, the present invention provides a round of ammunition comprising a cartridge casing having an internal chamber which extends between a nose opening and a base opening, together with a missile, an insert and a primer cap inserted into the internal chamber. The cartridge casing has an internal shoulder disposed at a junction between first and second portions of the internal chamber. The first portion has a larger diameter than the second portion and the latter extends from the shoulder to the nose opening. The primer cap is disposed so as to occupy at least part of the base opening. The insert has an empty internal passage which is sufficiently narrow to exclude the missile. The missile is ejectable from the casing via the nose opening upon the primer cap being detonated. The primer cap and the insert are removable from the casing via the base opening to allow the casing to be recharged with a further missile via the base opening.

It will be appreciated that for various reasons, various forms of missile can be employed, but in order to minimize the costs involved, it is proposed in the present invention to employ a known standard form of air gun pellet. It has been found that, by permitting the pellet to be inserted into the casing nose first, damage to the fragile skirt can be avoided during loading so that the accuracy during firing is not impaired.

The empty passage, in use, provides a flame duct to guide the explosion products of the primer cap to the rear of the missile. Experiments have indicated that the minimum length of the said passage with certain low power primer caps can be relatively short, i.e. down to about 12 mm. Thus, to avoid damaging the delicate skirt of the air gun pellet, it is preferred to make the length of this passage about 19 mm, plus or minus 2 mm. The passage may be longer for some types of practice round where sufficient internal length is available in the internal chamber of the casing. But to standardize production and to avoid undue dissipation of the energy of the explosion products, the length of the passage should not be much more than 19 mm.

Furthermore, while the overall diameter of the passage can be, with certain primer caps, as little as 2.5 mm, avoid undue restriction of the flow of explosion products along the passage, it is preferred that the diameter of the passage should be 3 mm or more. To avoid undue concentration of the explosion products into a small area at the rear of the pellet, which could damage the pellet, the diameter of the passage adjacent the rear of the missile is preferably at least 3 mm up to a maximum of 3.5 mm for a 0.177 pellet i.e. up to a maximum which is just sufficient to prevent the skirt of the pellet entering the passage. Since the pellets of other calibers may be employed, the preferred limit for the diameter of the passage adjacent the pellet can be stated as being at least two-thirds and preferably three-quarters or more of the overall maximum diameter of the pellet skirt as manufactured.

The diameter of the passage adjacent the primer cap may be less than the diameter of the passage adjacent the missile, to prevent the anvil or other internal mechanical parts of the primer cap from being expelled into the passage upon firing. However, the passage diameter adjacent to the primer cap should not be less than 3 mm and is preferably larger than this to avoid undue throttling of the flow of explosion products. Thus, for a standard 4.5 mm small pistol primer cap as used in the present invention to propel a 0.177 air gun pellet, the minimum is 3 mm and the maximum is 3.5 mm for the passage diameter adjacent the primer cap. Since other sizes of primer cap may be employed, the limits for the passage diameter adjacent the primer cap can be stated as being from 3 mm up to three-quarters of the diameter of the primer cap.

To prevent the missile being shaken from or falling out of the cartridge casing, the diameter of the second portion is preferably made slightly smaller than the overall maximum diameter of the missile as manufactured. However, the diameter of the second portion is still preferably slightly larger than the nominal diameter of the missile so that the missile can be fired into a standard calibre barrel or liner so that the skirt properly engages the rifling of the barrel or liner.

To protect the missile, it is preferred to hold the missile in a predetermined position in the internal chamber by trapping gently the peripheral edge of the skirt of the missile between an end of the insert and a radiussed, rounded or bevelled inner annular edge of the internal shoulder. The insert can be held in place by the primer cap if the latter engages the casing, But the primer caps vary slightly in size, the insert is not always located so as to gently trap the skirt of the pellet. It is therefore preferred to provide a socket within a base end part of the insert to receive the primer cap, and to make the insert a push fit into the first portion of the internal chamber. This arrangement offers the further advantage that the risks to the user can be reduced by supplying recharge assemblies comprising inserts ready fitted with primer caps so that the user does not have to push the primer caps into position.

To improve the location of the insert and to facilitate the insertion of the insert into the casing the base end part of the insert is preferably increased in overall diameter, e.g. by providing a ribbed or patterned outer surface, so that most of the insert can be slid easily into the casing before the base end part has to be pushed in. This arrangement provides the further advantage that during the easy sliding in of most of the insert, the missile can be gently moved along the first portion and partially into the second portion. Thus, the nose of the missile is past the internal shoulder before the pushing in of the base end part, thereby avoiding damage to the missile.

It will be readily appreciated that except for the known primer cap and missile, the ammunition includes only two relatively easy to make parts, of which only the casing needs to be varied in size and shape to fit a variety of small arms such as pistols and rifles.

At some small further cost in manufacture, a further risk of damaging the missile can be reduced by making the insert of composite form. The composite insert comprises an inner tubular member, which defines the empty passage, and an outer tubular member which defines the socket at one end of the inner tubular member, and a mouth at the other end of the inner tubular member. During manufacture, the pellet is inserted into the mouth via the socket, then the inner tubular member is inserted via the socket, and lastly the primer cap is inserted into the socket. The inner and outer tubular members are preferably arranged to trap gently the skirt of the pellet so that the latter is held in the mouth. The composite insert, pellet and primer cap together constitute a reloading assembly, which fits into said casing so that the end of the outer member around the mouth abuts the internal shoulder of the casing. This arrangement eliminates all handling of the pellets by the user, and thus any risk of damage to the skirt by such handling.

The external form of the casing is preferably shaped so as to have the same shape as a round of standard ammunition for a particular gun so as to be interchangeable with the standard round without regaining modification of the firing chamber or magazine of the gun.

The missile is preferably an air gun pellet or other lightweight missile having a weight of not more than twice the weight of a standard 0.22 caliber air gun pellet.

This form of missile will usually require the gun to be fitted with a barrel liner, but the ammunition of the invention offers certain advantages with respect to the fitting of liners.

When a gun is sleeved down to a lower caliber for normal known small caliber ammunition, the liner must be secured in the barrel with great accuracy and strength to withstand the explosive pressures in the breech during firing. Thus, such conversions are often permanent or semi-permanent, and it is extremely difficult to restore the gun to its original larger caliber. By way of contrast, the compressed air rechargable round of ammunition proposed by the Inventor, did not develop such high breech pressures, but the round necessitated very accurate longitudinal location of the liner in order to (a) prevent leakage of the compressed air, and (b) to serve as a reaction member during opening of the valve means. If the barrel liner was longitudinally out of position by a fraction of a millimeter, then leakage and loss of pellet velocity would arise, or misfiring due to non-opening or only partial opening of the valve means would arise.

In the present invention the positioning of the barrel liner in respect of (a) above is not critical, because on firing the missile will travel the length of the second portion before leaving the casing. Since the missile has a small weight, it accelerates rapidly to achieve a considerable velocity before entering the barrel liner. However, because of this high pellet velocity, the skirt of the pellet can be damaged easily as it enters the liner, so that known liners are not suitable.

What is needed for use with the ammunition of the invention is a form of liner which is easy to fit and remove from a gun, and which will not damage the skirt of the pellet.

To satisfy this need, a development of the invention provides, in a small arm having a barrel of a first caliber, the combination of a round of the ammunition of the invention together with a liner assembly. The liner assembly comprises a liner of a second caliber which is the same as the missile caliber and is smaller than the first caliber, together with securing means. A breech end portion is located co-axially in a breech end portion of the barrel by an annular resilient member located under compression between the said breech end portions. securing means is located at and is releasably actuable from a muzzle end portion of the liner releasably clampingly engage within a muzzle end of the barrel.

This arrangement provides the advantages that:

(a) any axial misalignment of the liner due to securing means is produced at the muzzle end and not at the breech if the small arm is properly constructed, the breech end portion of the liner is held accurately co-axial with the second portion of the internal chamber so as not to damage the missile, the gunsights can be adjusted easily to compensate for any breech end misalignment;

(b) the liner assembly can be removed or inserted in a few seconds without any dismantling or opening of the small arm; and (c) during removal or insertion of the liner, the annular resilient member guides the breech end portion of the liner into and along the barrel to avoid damaging the barrel.

To reduce the risk of damaging the missile, the breech end portion of the liner preferably includes a slight internal taper or chamfer so that, at the breech end the bore of the liner is the same as or is slightly larger than the diameter of said second portion of the internal chamber. The taper or chamfer angle is preferably only 1° to 5°.

Various types of explosive material are used in known primer caps, and tests have indicated that primer caps having a burning period or long explosion period so as to give a flame are to be preferred, rather than those types of primer caps which produce a very brief shock wave, i.e. which have a very brief explosion period, damage the skirts of air gun pellets.

BRIEF DESCRIPTION OF THE DRAWINGS

The present invention will be described, by way of example, with reference to the accompanying drawings, wherein.

DETAILED DESCRIPTION

Referring to FIGS. 1 to 7, each round of ammunition generally comprises a lightweight missile 10, a primer cap 11, a cartridge casing 12 and an insert 13.

Figure 1:
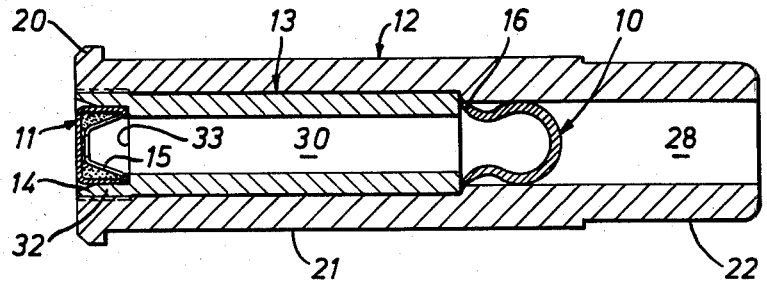
FIG. 1 shows a longitudinal cross section through a round of ammunition according to a first embodiment of the invention.

In the first embodiment shown in FIG. 1, the missile 10 is in the form of an ordinary 0.177 air gun pellet, and the primer cap 11 is of known readily available commercial small pistol form adapted to be fired by an impact from a firing pin of a 0.38 special pistol to produce a slow chemical explosion.

Figure 2:
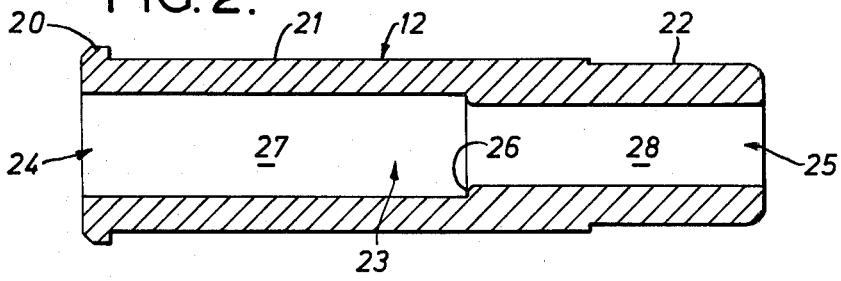
FIGS. 2 and 3 respectively show, in longitudinal cross section, a casing and an insert of the embodiment shown in FIG. 1.

The cartridge casing 12 is externally shaped so as to be substantially the same as a known standard round of small arms ammunition, e.g. in the first embodiment shown in FIGS. 1 and 2 the casing 12 has an extractor flange 20, a portion 21 shaped to represent the cartridge of a 0.38 pistol (revolver) ammunition round, and a portion 22 shaped to represent the bullet of the pistol ammunition round, so that the casing 12 can be loaded into a 0.38 pistol as an alternative to the pistol ammunition round.

In all four embodiments casing 12 is internally shaped so as to define an internal chamber 23 which extends from a base opening 24 to nose opening 25, and an internal shoulder 26. The internal shoulder 26 is disposed between a large diameter first portion 27 of the chamber 23, and a small diameter second portion 28 of the chamber 23, so as to face toward the base opening 24.

The insert 13 in all four embodiments is shaped externally to fit into the first portion 27 of the chamber 23 so as to abut the shoulder 26, and is shaped internally so as to include an empty internal passage 30 which is sufficiently narrow to exclude the missile.

Figure 3:
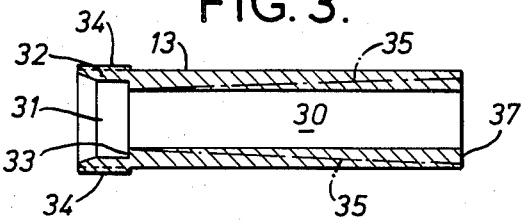

In the first embodiment shown in FIGS. 1 to 3, the insert 13 has a socket 31 in a base end part 32. Socket 31 is dimensioned to accept the small pistol primer cap 11, so that the base of the latter occupies most of the base opening 24 and so that the anvil 15 and wall 14 of the cap 11 are supported by a seating 33 (FIG. 3) provided within the socket 31. Thus, cap 11 will not enter the end of the empty passage 30 adjacent the socket 31. The socket 31 is tapered or chamfered to facilitate insertion of the cap 11. The peripheral surface of the base end part 32 includes shallow longitudinal fins or ribs 34 to increase slightly the overall diameter of the peripheral surface Thus, base end part 32 is a tight push fit into the first portion 27. The overall diameter of most of the insert 13 is such that it is a sliding fit in the first portion 27. While many materials may be used for making the casing and insert, in this embodiment the casing 12 is of a hard plastics material and the insert 13 is of metal so that the fins or ribs 34 engage shallowly in the casing.

Figure 4:
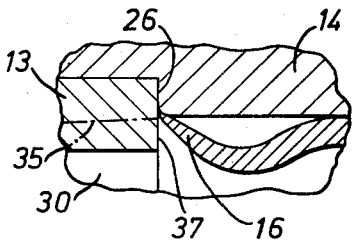
FIG. 4 is an enlarged cross sectional detail showing diagrammatically portions of the casing and insert together with a portion of a missile.

Referring to FIGS. 2, 3 and 4, in the first embodiment the passage 30 has a length of about 19 mm from the socket 31 and a diameter of about 3.5 mm; the socket 31 has a diameter of about 4.5 mm so that the seating 33 is about 0.5 mm wide radially; the second portion 28 has a diameter of about 4.6 mm; and the first portion 27 has a diameter of about 5.8 mm so that the internal shoulder 26 is about 0.6 mm wide radially. The internal shoulder 26 is rounded or chamfered to leave a tapered annular recess between the end 37 of the insert 13 and the shoulder 26, in which recess is trapped the peripheral edge portion of the relatively fragile flared skirt 16 of the pellet 10, as shown in detail in FIG. 4.

As indicated in broken lines 35 in FIGS. 3 and 4, the passage 30 may diverge towards the pellet 10, so that the nose end of the passage is only just small enough to prevent the pellet 10 entering the passage.

Figure 5:
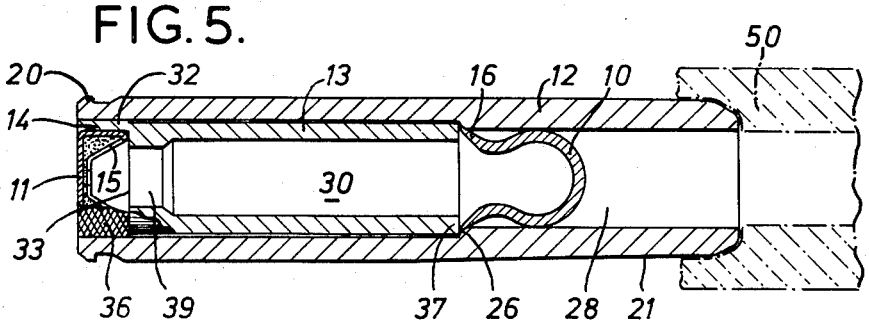
FIG. 5 shows a second embodiment of the invention in longitudinal cross section.

As described hereinafter with reference to FIG. 8, the first embodiment is intended to be used in combination with a barrel liner, whereas the second embodiment shown in FIG. 5 is designed to be used without a barrel liner in a 5.56 mm caliber rifle.

The second embodiment is generally similar to the first embodiment except for certain differences. The casing 12 is externally shaped so as to be substantially the same as the cartridge casing, without the bullet, of the standard rifle round. This modification makes necessary the use of a modified magazine for the rifle to compensate for the length of the missing bullet, but the rifle needs no structural modification. The missile 10 is in the form of an air gun pellet made to 5.56 mm nominal caliber and so that the skirt 16 is about 6 mm in diameter. The primer cap 11 is a standard large primer cap having a moderate burning period. The insert 13 and casing 12 are made from hard plastics material. The peripheral surface of base end part 32 includes a raised pattern 36 which frictionally engages the first portion 27, whereas the rest of the insert is a free sliding fit in the first portion. The internal passage 30 has a short restricted portion 39 of about 3.5 mm diameter adjacent the socket 31 which has a 5.3 mm diameter, so that the seating 33 has a radial width of about 0.9 mm; and the rest of the internal passage has a diameter of about 4.5 mm. The length of the passage 30 is about 19 mm. The first portion 27 has a diameter of about 6.6 mm. The second portion has a diameter of 5.58 mm, slightly larger than the bore of the rifle, so that when the pellet is expelled from the second portion the skirt 16 can properly engage the rifling and walls of the barrel of the rifle. The breech end portion 50 (shown in broken lines in FIG. 5) of the barrel of the rifle is chamfered so that the skirt 16 is not damaged as it enters the barrel.

In the first and second embodiments, the cap 11 and insert 13 may be sold ready assembled as a recharge assembly to avoid the necessity for the user to handle primer caps.

Figure 6:
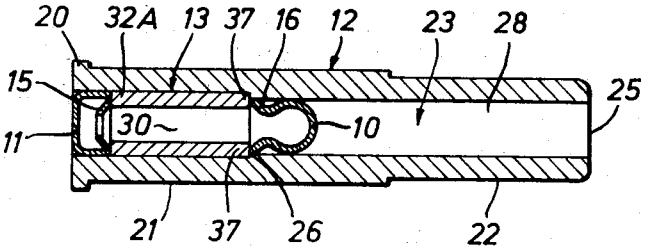
FIG. 6 shows diagrammatically a third embodiment of the invention in longitudinal cross section.

In the third embodiment shown diagrammatically in FIG. 6, the base opening 24 is wholly occupied by the primer cap 11 which is a push fit into the first portion 27 of the chamber 23. In the third embodiment the socket 32 is omitted so that the passage 30 extends from that one end 37 of the insert 13 which abuts the shoulder 26 to the base end 32A of the insert 13, and the base end 32A serves as an abutment to provide a seating for the primer cap.

In the first, second and third embodiments, the missile 10 is disposed in the second portion of the chamber 23. The diameter of the second portion is slightly less than the maximum diameter of the missile before the latter is inserted into the casing 12. Thus, even if the skirt 16 is not trapped between the insert and the internal shoulder, the missile will be held by friction in this second portion.

The first three embodiments are assembled by inserting the missile 10 through the base opening 24 and first portion 27 into the second portion 28 of the chamber 23, prior to the insert 13 and the primer cap 11 being inserted into the casing 12, so as not to damage or distort the missile skirt 16. The third embodiment may be sold ready assembled as a disposable round of ammunition.

Figure 7:
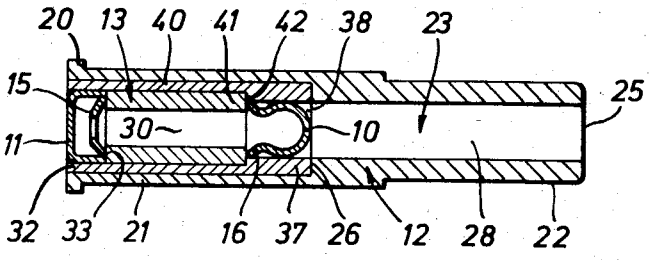
FIG. 7 shows diagrammatically a fourth embodiment of the invention in longitudinal cross section.

The fourth embodiment, shown diagrammatically in FIG. 7 is similar to the first embodiment, except in that the insert 13 is of composite form to define a mouth 38 in which the missile 10 is accommodated. The insert comprises an outer tubular member 40 and an inner tubular member 41, which defines the passage 30 and is slidably accommodated in the member 40 so as to abut a second internal shoulder 42. The mouth 38 extends from said shoulder 42 within the end 37 of the insert. In the fourth embodiment the cap 11 is a push fit in the member 40 and the inner member 41 serves as an abutment to provide a seating for the cap 11. In the fourth embodiment, the missile can be inserted nose first into the outer member 40, so as to enter the mouth, before the member 41 is inserted into the member 40 to form a missile and insert assembly in which the missile is located. Cap 11 can be inserted into the assembly after the member 41 to form a reloading assembly for reloading a spent round of the ammunition. The reloading assemblies may be mass produced and sold ready for the user to insert them into the casings 12, to avoid a user having to handle the missiles and caps separately when reloading the spent ammunition. The mouth 38 has the same diameter as the second portion 28, and the end 37 abuts the shoulder 25, which is not rounded or bevelled.

In the third and fourth embodiments the casing 12 is of plastics material and insert 13 is of metal, but either or both may be of plastic material or metal. The passage 30 has a length sufficient to prevent the explosion products, produced by detonating the primer cap 11, from damaging the missile 10, and experiments indicate that this length is preferably about 19 mm.

Figure 8:
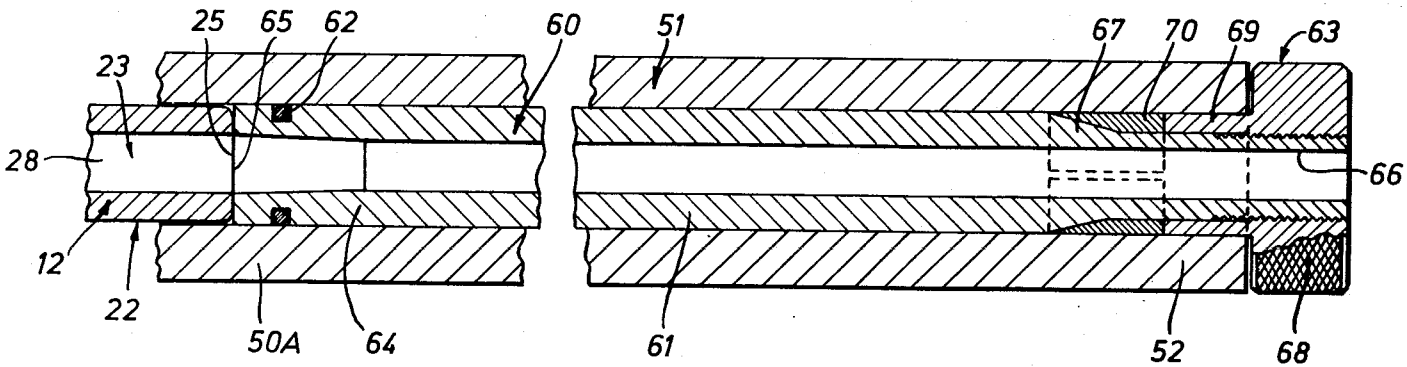
FIG. 8 shows in longitudinal cross section part of the first embodiment in combination with the barrel of a firearm and a liner assembly in accordance with the invention.

Referring to FIG. 8, the firearm assembly includes a known firearm, a liner assembly, and a round of ammunition. In FIG. 8, only a barrel 51 of the firearm and the portion 22 of the cartridge casing 12 are shown together with the liner assembly 60. The rifling in the barrel and liner is omitted in FIG. 8. The liner assembly comprises a linear 61, an annular member 62 and securing means 63. The barrel 51 has a breech end portion 50A of known form which can accept a standard center fire firearms cartridge or the casing 12, and projects into a firing chamber of the gun in known manner.

The liner 61 has a breech end portion 64 which is internally tapered or widened slightly, e.g. at an angle of 1° to 3°, so that the opening 65 at the breech end of the liner has the same diameter as the nose opening 25. The opening 65 is held co-axial with the bore of the barrel by the member 62 to facilitate the missile 10 entering the liner 61. The liner 61 has a muzzle end 66 which is externally reduced in diameter and threaded; and has a conically tapered portion 67 adjacent the muzzle end 66. The member 62 is in the form of an "O" ring seal of resilient material located in an external channel around the breech end portion 64 to provide a compression seal between the portions 50A and 64.

The securing means 63 comprises a muzzle piece 68 in the form of an internally threaded fastener having a cylindrical extension 69 which extends into the muzzle 52 of the barrel 51; and a tapered expansible device 70 in the form of a split ring in this embodiment, but which may be in the form of a plurality of collets. The split ring 70 may be separate from or integral with the extension 69. The expansible device engages the extension 69, the portion 67 and the barrel muzzle 52 to clamp the liner 61 in the barrel 51 when the muzzzle piece 68 is secured onto the muzzle end 66 of the liner 61 as shown in FIG. 8.

The arrangement of the round of ammunition and liner assembly is such that when the gun is fired, the firing pin strikes centrally on the exposed end of the primer cap 11 whereby to detonate the primer cap 11. The thrust of the firing pin is transmitted from the cap 11 to the casing 12 via the insert. The explosion gases from the cap pass through the passage 30 to propel the missile 10 into the liner 61, via the nose opening 25 and the tapered breech end portion 64, without damaging the skirt of the missile so that the latter can properly engage and travel along the bore of the liner 61. In the examples shown in the drawings tests have shown that the missiles can be assembled into the round, nose first, and propelled into the liner 61 or barrel (FIG. 5) without the skirt 16 suffering any damage sufficient to prevent the skirt 16 forming a seal with the liner or barrel so that the missile can be fired at high velocity and with considerable accuracy, but with a relatively low kinetic energy. For example, using a small pistol primer cap and a .177 caliber air gun pellet missile in a pistol, velocities giving the missile about 6 foot pounds of kinetic energy can be achieved; and using a large primer cap and a .22 caliber air gun pellet missile in a rifle, velocities giving the missile about 12 foot pounds of kinetic energy can be achieved.

After firing, the insert and spent cap can be pushed backwardly out of the casing so that a further missile or reloading assembly can be inserted.

The liner assembly can be fitted to and remove from a predetermined firearm in a few seconds via the muzzle of the barrel, without harming or requiring any dismantling or modification of the firearm; and materially contributes to the utility of the improved ammunition of the invention when employed in conjunction therewith.

Furthermore, the explosion products of the primer caps are cleaner than the products of the standard ammunition, so that the invention greatly reduces fouling of the liner and barrel, and reduces pollution.

While the ammunition for small arms has been shown and described in detail, it is obvious that this invention is not to be considered as being limited to the exact form disclosed, and that changes in detail and construction may be made therein within the scope of the invention, without departing from the spirit thereof.

I claim:

1. A round of ammunition comprising:

(a) a cartridge casing having a nose opening and a base opening at opposite ends thereof and an internal chamber extending longitudinally between said nose and base openings, (b) the internal chamber including first and second chamber portions having different diameters and an internal shoulder at the junction of the first and second chamber portions, (c) the first chamber portion having a larger diameter than the second chamber portion and extending from said base opening to said internal shoulder, (d) a missile having a front body portion and a trailing edge portion and being located in said internal chamber with said front body portion disposed in said second chamber portion, (e) said trailing edge portion being larger than the diameter of said second chamber portion to effect positioning of the trailing edge portion at said internal shoulder, (f) a removable insert having inner and outer ends and an empty internal passage extending through the inner and outer ends thereof and being sufficiently narrow to exclude the missile positioned at the internal shoulder, (g) said insert being located in the first chamber portion to abut the internal shoulder with its inner end and being extractable from and insertable into said first chamber portion only via said base opening, and (h) primer means disposed to occupy at least a portion of said base opening at the outer end of the removable insert.

2. A round of ammunition as defined in claim 1, wherein said empty internal passage has a length of at least 12 mm with a diameter adjacent the missile of at least two-thirds of the maximum diameter of the missile and a diameter adjacent the primer means of no more than three-quarters of the diameter of the primer means.

3. A round of ammunition as defined in claim 1, wherein said empty internal passage has a length within the range of 17 mm or 21 mm and a diameter adjacent the missile of at least three-quarters of the maximum diameter of the missile.

4. A round of ammunition as defined in claim 3, wherein the diameter of the empty internal passage adjacent the primer means is less than the diameter of the empty internal passage adjacent the missile.

5. A round of ammunition as defined in claim 1, wherein the primer means includes a primer cap, and the insert includes a base end part located at said outer end and having an internal socket in which the primer cap is located, and part of the peripheral outer surface of the insert has a greater overall diameter than the rest of the peripheral outer surface of the insert.

6. A round of ammunition as defined in claim 5, wherein said part of the peripheral outer surface is ribbed or patterned.

7. A round of ammunition as defined in claim 1, wherein the diameter of the second chamber portion is smaller than the maximum diameter of the missile as manufactured and is larger than the nominal caliber diameter of the missile, and the missile comprises an air gun pellet having a skirt which constitutes said trailing edge portion.

8. A round of ammunition as defined in claim 1, wherein the missile comprises an air gun pellet having a skirt which constitutes said trailing edge portion, said internal shoulder has rounded, radiused or beveled inner annular edges, and the skirt is trapped between said edge and an end of the said insert.

9. In a firearm having a barrel of a first caliber, the combination of:

(a) a round of the ammunition as claimed in claim 1 together with a liner assembly, (b) the liner assembly comprises a liner with securing means, (c) said liner being of a second caliber which is the same as the missile caliber and is smaller than the first caliber, (d) a breech end portion of the liner is located co-axially in a breech end portion of the barrel by an annular resilient member located under compression between said breech end portions, and (e) the securing means is located at and is releasably actuable from a muzzle end of the liner to releasably clampingly engage within the muzzle end of the barrel.

10. A combination as defined in claim 9, wherein said securing means comprises an internally threaded muzzle and threadably engaged on an externally threaded muzzle end portion of the liner, a conically tapered portion of the liner, and an expansible device located around the liner to engage said conically tapered portion, and the breech end portion of the liner includes an internal taper of less than 5°, so that, at the breech end, the diameter of the bore of the liner is at least as large as the diameter of said second chamber portion of the internal chamber.

11. A round of ammunition comprising:

(a) a cartridge casing having a nose opening and a base opening at opposite ends thereof and an internal bore extending longitudinally between said nose and base openings, said internal bore having a forward bore portion with a smaller diameter than a rearward bore portion (b) a removable insert having inner and outer ends and an empty internal passage extending through the inner and outer ends thereof, (c) said insert being located in the internal bore and being extractable from and insertable into said internal bore only via said base opening, (d) the insert comprising a removable inner tubular member disposed in an outer tubular member, (e) the inner tubular member defines the empty internal passage which extends through the ends of the inner tubular member and the outer tubular member defines a mouth at one end of the insert, (f) the outer tubular member including first and second chamber portions which extend through the ends of the the outer tubular member having different diameters and an internal shoulder at the junction of the first and second chamber portions, (g) the first chamber portion having a larger diameter than the second chamber portion and extending from said outer end to said unternal shoulder, (h) a missile having a front body portion and a trailing edge portion, said front body portion being located in the second chamber portion of the outer tubular member with said trailing edge portion being larger than the diameter of said second chamber portion to effect positioning of the trailing edge portion at the internal shoulder of the outer tubular member, (i) said inner tubular member being located in the first chamber portion to abut the shoulder of the outer tubular member, said inner tubular member being extractable from and insertable into said first chamber portion only via said outer end of said insert, said internal passage of the inner tubular member being sufficiently narrow to exclude the missile positioned at the internal shoulder and (j) primer means disposed to occupy at least a portion of said base opening at the outer end of the removable insert.

* * * * *